United States Patent [19]

De Rooy

[11] Patent Number: 4,703,869

[45] Date of Patent: Nov. 3, 1987

[54] AIR CANNON

[76] Inventor: Johannes J. De Rooy, Kombos 14, 3941 KL Doorn, Netherlands

[21] Appl. No.: 868,365

[22] Filed: May 27, 1986

[30] Foreign Application Priority Data

May 24, 1985 [NL] Netherlands ..... 8501483

[51] Int. Cl.[4] ..... B67B 7/24

[52] U.S. Cl. ..... 222/3; 222/195; 251/63

[58] Field of Search ..... 222/195, 3, 196, 394; 137/533.19, 509; 251/63

[56] References Cited

U.S. PATENT DOCUMENTS 2,627,873 2/1953 Bothe ..... 251/63

3,788,527 1/1974 Matson ..... 222/195

*Primary Examiner*—Joseph J. Rolla

*Assistant Examiner*—Kenneth Noland

*Attorney, Agent, or Firm*—Flynn, Thiel, Boutell & Tanis

[57] ABSTRACT

An air cannon which includes a pressure tank with an inlet opening and an outlet opening for air, whereby the outlet opening is composed of a tube which is airtightly fastened in the wall of the pressure tank and the one open end terminates inside the pressure tank and the other open end extends out of the pressure tank. A cylindrical shaped second tube is fixed in the pressure tank with an open end and a closed end, generally concentric to the mentioned first tube, of which the cross section is larger than the cross section of the first tube. The first tube extends through the open end into the inside of the second tube, and is generally concentric to it. In the bottom of the second tube there is provided an in and outlet opening for the in and outflow of air. On the bottom of the second tube generally concentric to the aforementioned tubes, a third tube is provided having a smaller diameter and a shorter length than the second tube with the one end airtightly fastened to a wall of the pressure tank and being of such a length that between the end of the first tube and the third tube in the interior of the second tube there is provided a space. A disk is placed in the space, which near the circumference is provided with two collars which engage the interior wall of the second tube to guide the disk for movement back and forth between the ends of the first and the third tube.

7 Claims, 4 Drawing Figures

AIR CANNON

FIELD OF THE INVENTION

The invention relates to a device to produce at a given moment an air blast, hereafter to be called air cannon, consisting of a pressure tank with an inlet opening and an outlet opening for air, of which the outlet opening consists of a first tube, which is airtightly attached in the wall of the pressure tank, for example welded, and the one open end of the tube debouches in the pressure tank and the other open end outside the pressure tank, and that in the pressure tank a cylindrical second tube is fixed with an open and a closed end, more or less concentric to the mentioned first tube and, of which the cross section is larger than the cross section of the first tubing and the first tube debouches through the open end in the second tube and that more of less concentric to it on the bottom or the second tube an in and out flow opening is placed for the supplying and carrying off of air, whereby the out flow opening can be cut off by means of a closing member. Such devices are used by silos or large containers, wherein granular material is stored, if the stored material will not flow out of the silo, caused by a so-called bridge formation. By placing air cannons at given places in the wall of the silo the discharge of the blocked material can be activated again by the giving of an air blast.

BACKGROUND OF THE INVENTION

Such a device, an air cannon, is among other things described in U.S. Pat. No. 3,788,527, wherein a pressure tank via an outflow opening, which is locked by means of a piston, can at a given moment be suddenly emptied via a tube. This piston is placed in a cylinder and can be brought into two possible end-positions. In the one end-position the outlet opening of the pressure tank is closed, in the other end-position open. The piston and the cylinder must, within a certain tolerance, be quite exact in diameter.

The aim of the invention is an air cannon, whereby parts can be used, which need not be manufactured with great precision, so that an apparatus can be constructed that will be cheaper than the known air cannons. Another aim of the invention is an air cannon, which can release the air faster than the up till now known air cannons.

This object of the invention is achieved with an air cannon according to the invention, wherein that on the bottom of the second tube more or less concentric to the aforementioned tubes, a third tube with a smaller diameter and shorter than the second tube is airtightly fastened on it with the one end being of such a length that between the ends of the first tube and the third tube, there is a space left inside the second tube, wherein a disk is placed, which near the circumference is provided with two collars, which project to both sides and stand some-what slanting outward, so that the disk can be moved back and forth between the ends of the first and the second tubes. With such an apparatus it is possible to open the pressure tank very quickly because the piston can be made very light. Also normal tubes can be used without the walls needing an extra machining. An extra advantage is that if the piston is moved in the open position, then an amount of air under pressure will be enclosed between the second and the third tube and the disk, so the disk is slowed down before being pressed onto its seats. The application of a disk to block the outlet opening of the pressure tank is already known from the European patent application published under number 0 021 999 but in that construction the disk is moved back and forth between the two possible extreme positions by means of a resilient membrane. That construction has the disadvantage that a membrane within a certain time period will show breakage, because rather high demands have to be made of the membrane.

In a preferred embodiment of the air cannon according to the invention, the second tube is fastened on a flange, which forms the bottom of this tube and which flange can be airtightly fastened to a flange of the pressure vessel. This construction makes it easy to replace the mechanism for the blocking of the outlet opening of the pressure tank, if this shows defects.

Preferably, the inlet opening, through which the pressure tank is filled with air, is made in the flange; naturally, it is also possible to bring on this opening directly in the wall of the pressure tank or as is generally done at present in the wall of the second tube, whereby this opening has been placed such that, at the moment that the piston blocks the outlet opening, the openings via the in and outlet opening in the bottom of the third tube let through the air to the pressure vessel, while if the outlet opening is opened and the disk is placed in the other end position, then the openings in the wall of the second tubular part do not stand in communication with the in and outlet opening in the bottom of the second tube.

The disk is preferably made out of a metal disk covered by rubber or plastic sheet; the collars are also made of rubber or plastic whereby these are somewhat resilient.

BRIEF DESCRIPTION OF THE DRAWINGS

By the drawings the invention will be further described. In the drawings is shown in.

DETAILED DESCRIPTION

Figure 1:
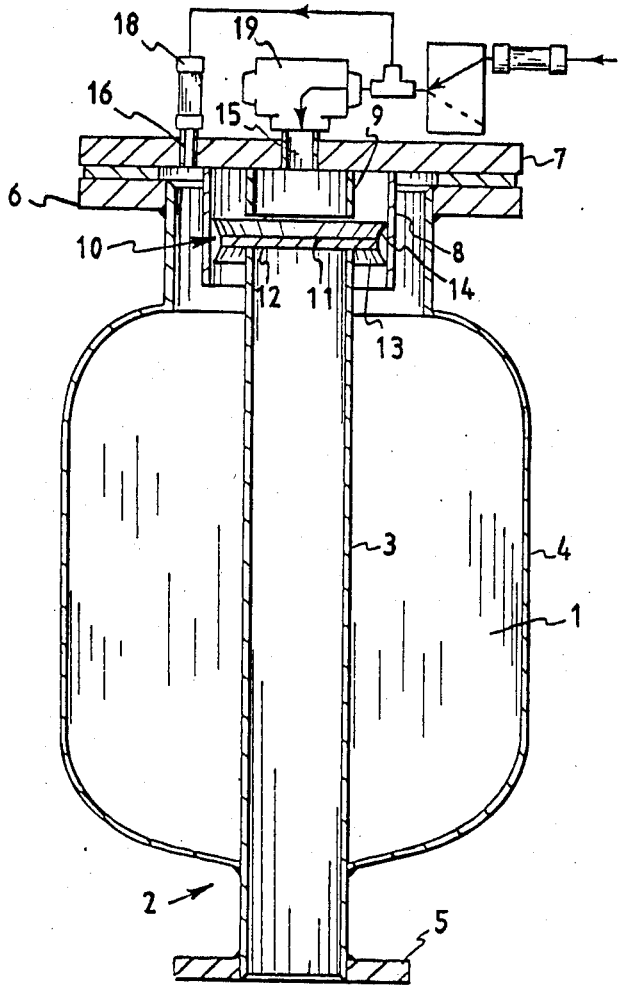
FIG. 1 illustrates an air cannon according to the invention with the outlet opening of the pressure vessel closed.
Figure 2:
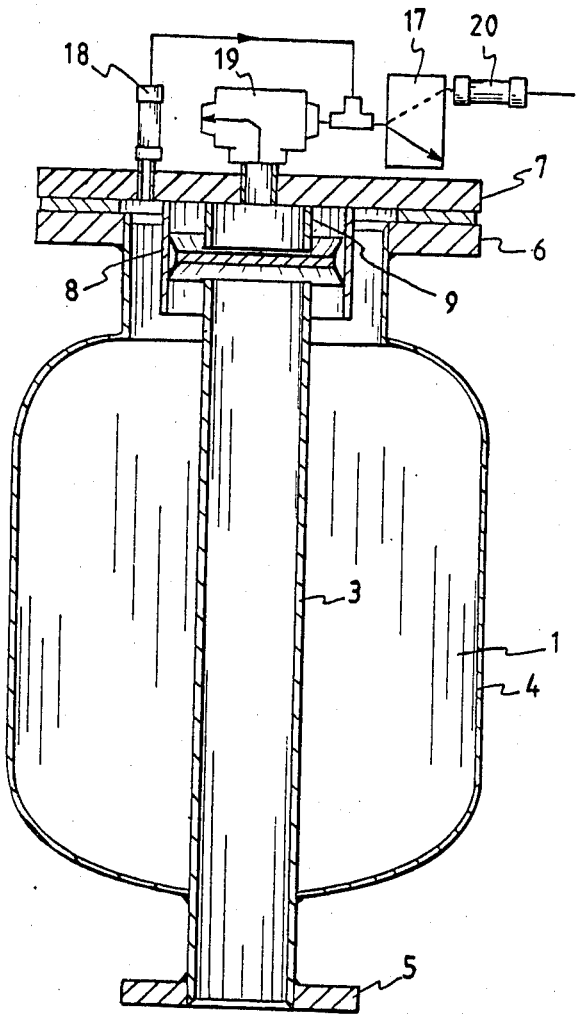
FIG. 2 illustrates the same apparatus as pictured in FIG. 1 but with the outlet opening opened.

The FIGS. 1 and 2 show the same air cannon according to the invention with a valve in two different positions. The air cannon comprises a pressure tank 1 with an outlet opening 2 for the air from the pressure tank 1. The outlet opening consist of a first tube 3, which is airtightly fastened in the wall 4 of the pressure tank 1. A flange 5 is fastened in the wall 4 at the end of the tube for easy dismounting of the air cannon on a silo. This air cannon according to the invention has a flange 6, whereon a flanged branche 7 is fastened. On the flanged branche is airtightly welded a second tube 8 and concentric in the second tube 8 a third tube 9 of which the diameter is smaller and the length shorter than of the second tube 8. The diameter of the second tube 8 is larger than the diameter of the first tube 3. The first tube 3 and the third tube 9 are almost in line of each other and between the both ends of the first tube 3 and the third tube 9 is a space, wherein a valve 10 is placed. The disk is here made out of a metal inner disk 11 covered with a rubber jacket 12. The rubber jacket 12 has two rubber collars 13, 14, which slant outward to both sides. The outer diameter of the disk with rubber jacket and collars corresponds approximately with the inner diameter of the second tube 8. In the flange concentric to the tubes is an in and outlet opening or orifice 15. In the flange 7 is also a second inlet opening 16 for air, through which the pressure tank can be directely filled with air. Via a threeway valve 17 and a non return valve 18, which are mounted on the inlet opening 16, the pressure tank 1 can be filled with air under pressure. Simultaneously, via a quick air release valve 19 and the opening 15, air under the same pressure can flow into the space defined by the flange 7, the wall of the second tube 8 and the disk 10. Because this space is much smaller than the capacity of the pressure tank 1, it will be earlier on pressure and the disk, when put under pressure, will directly take in the position as pictured in FIG. 1 and close the end of the tube 3.

OPERATION

The operation of the air cannon is as follows: FIG. 1 describes how the air cannon is made ready for use. From an air supply via a nonreturn valve 20, the threeway valve 17 and the quick air release valve 19, air flows into the space before the disk. Simultaneously, the pressure tank is filled via the nonreturn valve 18. As already described above the disk will be pressed against the end of the tube 3 and hermetically seal this. During the inflow of air, the collar or closing lip 14 of the disk 10 will be pressed against the wall of the tube 8, so that no air will be able to escape along the rim of the disk. If the pressure in the pressure tank and the space above the disk 10 are equal to the pressure of the air supplied by the air supply, the folling will cease and the pressure in the pressure tank and above the disk will be the same. The disk will then be kept pressed against the end of the tubular part 3, as the force applied on the upperside of the disk is larger than on the otherside of the disk. This is due because partly on the bottomside of the disk, namely that part that presses on the tube end, the atmospheric pressure prevails. In this position the air cannon is ready to be fired.

FIG. 2 indicates how the air cannon can be discharged. First the threeway valve 17 is set in the indicated position, so that the air can escape from the supply line, which lead to the pressure tank. Through this the quick air releaser will start to function and in a fraction of a second empty the space above the disk. This will cause that the disk 10 to be pressed upward due to the overpressure of the pressure tank in a fraction of a second, whereby the air content of the pressure tank is exhausted rapidly via the tube 3. The closing lip of the collar 13 of the disk 10 will be pressed against the wall of the tubular part 8, so that no air can escape along the disk 10. When due to the overpressure the disk 10 is pushed into the uppermost position, the space between the tube 8 and the tube 9 will be covered by the disk before the air has time to flow away. Through this a kind of buffer effect will evolve from this air amount which is more or less locked up, whereby the disk will eventually not directly be pressed with full force onto the end of the tubular part 9. This causes the forces which are applied onto the disk, at the moment of releasing of the air cannon, to be limited to a minimum.

After the air cannon is released, the air cannon can be filled again with air under pressure resetting the threeway valve in the filling position and to bring the valve back into its initial position.

Because of the flexibility of the collars or closing lips 13, 14 of the disk 10, which serve not only to make it air tight, but also for guiding of the disk, there is no need for machining with great exactness. The wall of the tubular part 8 along which the disk 10 glides also need not to be made accurate and can be manufactured of normal commercial quality seamless steel tube, so that all kinds of costly operations, such as grinding, become unnecessary. The inner wall of the tubular part 8 can possibly be provided with a high quality plastic coating.

Figure 3:
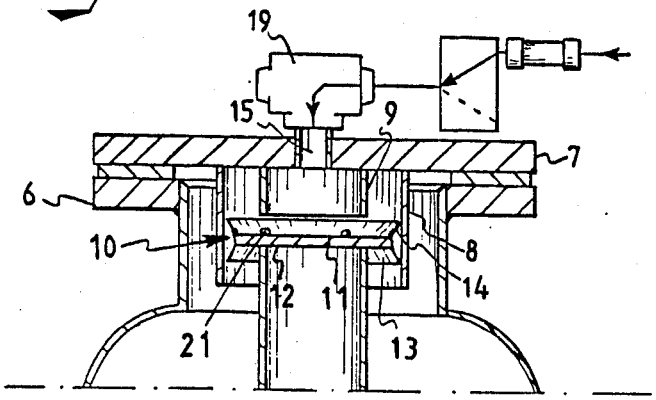
FIG. 3 shows a first alternate embodiment.
Figure 4:
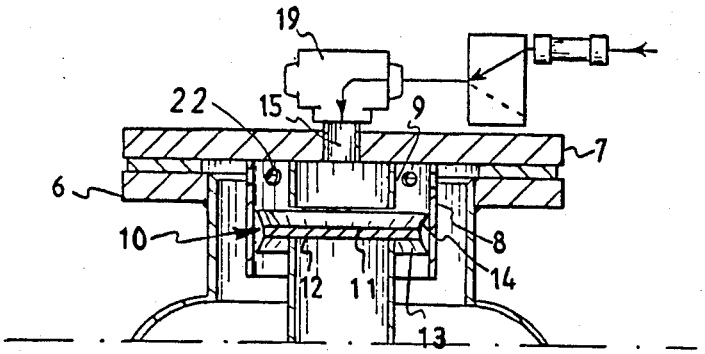
FIG. 4 shows a second alternate embodiment.

FIGS. 3 and 4 show two other possible embodiments of the air cannon. FIG. 3 shows small holes 21 which are made in the wall of the collar 14 of the disk 10, through which the air enclosed by the space bounded by the tubular part 8 and the flange 7 can flow to the space bounded by the two collars 13, 14 of the disk 10. Through this it is possible to fill the pressure tank directly instead through the supplier 18. If the disk has been brought into position by the high pressure, so that the outlet opening of the pressure tank is closed, the air can flow through the small holes 21 to the space in between the collars 13, 14 and then past the collar 13 into the pressure tank 1. By the firing of the air cannon, the collar 13 will then be pressed against the wall of the tubular part 8 and through this the air will not be able to flow back to the quick air releaser. The small holes will preferably be made in the collar near the point where this is fastened to the disk.

FIG. 4 shows an alternate embodiment of the air cannon in which several openings 22 are provided in the wall of the second tube 8. Thus, the pressure tank can be filled with air through these openings 22 directly.

The embodiments of the invention in which an exclusive property or privilege is claimed are defined as follows:

1. In an air cannon apparatus for producing at a given moment an air blast, comprising a pressure tank with an inlet opening for air, an outlet opening composed of a first tube which is airtightly fastened in a wall of said pressure tank and the one open end terminates inside said pressure tank and the other open end extends out of said pressure tank, and that in the pressure tank a cylinder shaped second tube is fixed to a further wall and has an open end and a closed end, generally concentric to the mentioned first tube, of which the cross section of said second tube is larger than the cross section of said first tube and said first tube extends through the open end into the inside of the second tube, and that generally concentric to it in the bottom of said second tube an in and outlet opening is provided for the in and outflow of air, comprising the improvement wherein on the bottom of said second tube generally concentric to the aforementioned first and second tubes, a third tube having a smaller diameter and a shorter length than said second tube is provided with one end thereof airtightly fastened to said further wall and having a length such that between the ends of said first tube and said third tube in the interior of said second tube there is provided a space, wherein a disk is provided in said space and has near the circumference two collars which engage an inside wall on said second tube to guide said disk for movement back and forth between the ends of said first and said third tube.

2. The apparatus according to claim 1, wherein said second tube is fastened on said further wall, which forms the bottom of the tube and which wall is airtightly fastened to a flange of said pressure tank.

3. The apparatus according to claim 1, wherein said inlet opening, through which said pressure tank is filled with air, is provided in said wall of said pressure tank.

4. The apparatus according to claim 1, wherein said inlet opening, through which said pressure tank is filled with air, further includes at least one opening in the wall of said second tube.

5. The apparatus according to claim 1, wherein said disk is composed of a firm material.

6. The apparatus according to claim 1, wherein said disk comprises a a disk of hard material, which is provided with a jacket of at least one of leather, rubber, plastic and the like.

7. The apparatus according to claim 1, wherein a quick air releaser is provided and is connected in circuit with said opening, wherein on the upper side of said disk on the side of said quick air releaser, in the collar or near the collar at least one opening is provided so that a communication is created between the space on the side of said quick air releaser and the space bounded by said two collars on said disk.

* * * * *